US005967664A

United States Patent [19]

Giles et al.

[11] Patent Number: 5,967,664

[45] Date of Patent: Oct. 19, 1999

[54] SIFT PROOF VALVE BAG

[75] Inventors: Don Graham Giles, Salt Lake City; Robert G. Kelley, South Jordan, both of Utah

[73] Assignee: Stone Container Corporation, Chicago, Ill.

[21] Appl. No.: 09/138,496

[22] Filed: Aug. 24, 1998

Related U.S. Application Data

[63] Continuation of application No. 08/643,930, May 7, 1996, abandoned.

[51] Int. Cl.[6] ..... B65D 30/26

[52] U.S. Cl. ..... 383/54; 383/53; 383/109; 383/114; 383/125

[58] Field of Search ..... 383/125, 126, 383/44, 53, 54, 109, 114

[56] References Cited

U.S. PATENT DOCUMENTS

| | | | |
|---|---|---|---|
| 2,078,467 | 4/1937 | Sterling | 383/126 X |
| 2,147,970 | 2/1939 | du Bois . | |
| 3,130,897 | 4/1964 | Poklukar et al. . | |
| 3,191,850 | 6/1965 | Niemeyer . | |
| 3,237,534 | 3/1966 | Lissner | 383/125 X |
| 3,261,267 | 7/1966 | Becker . | |
| 3,397,622 | 8/1968 | Goodwin | 383/125 |
| 3,448,666 | 6/1969 | Kappelhoff et al. | 383/125 X |
| 4,049,191 | 9/1977 | Stearley . | |
| 4,367,620 | 1/1983 | Fox . | |
| 4,391,404 | 7/1983 | Welter . | |
| 4,453,270 | 6/1984 | Donini et al. . | |
| 4,759,640 | 7/1988 | Groener . | |

FOREIGN PATENT DOCUMENTS

| | | | |
|---|---|---|---|
| 34606 | 4/1973 | Australia . | |
| 1 370 903 | 7/1964 | France | 383/125 |
| 2 228 004 | 11/1974 | France . | |
| 869 292 | 3/1953 | Germany | 383/125 |
| 1 213 783 | 3/1966 | Germany | 383/125 |
| 2 218 867 | 10/1973 | Germany . | |
| 32 03 187 | 8/1983 | Germany . | |
| 1 000 847 | 8/1965 | United Kingdom | 383/125 |

*Primary Examiner*—Jes F. Pascua
*Attorney, Agent, or Firm*—Dick and Harris

[57] ABSTRACT

A valved bag is provided, having first and second end portions, and at least one in-folded flap member and at least one outer flap member affixed to at least one of the first and second end portions. A cover member is positioned and affixed to the in-folded flap member and outer flap member, prior to final closure of same, for preventing the undesired escape of material from within the bag, subsequent to closure of the ends and filling of the bag.

11 Claims, 2 Drawing Sheets

SIFT PROOF VALVE BAG

This application claims priority, as a continuation application, under 35 U.S.C. 120, of U.S. non-provisional patent application No. 08/643,930, filed May 7, 1996 and now abandoned.

BACKGROUND OF THE INVENTION

The present invention is directed to bags for the containment of particulate or granular material, in particular to valve bags.

A valve bag is a flexible bag container having a body portion of substantially tubular configuration, which typically has an outer layer of at least one ply, and an inner layer of at least one ply. Typically, the plies may be made from a relatively stiff and sturdy, yet flexible, paper material, such as kraft paper. Valve bags are typically utilized for the transportation of bulk material that is granular, powdery, or particulate in form.

One end of the bag (usually the end the ultimate consumer opens) may be cut in a stepped end pattern, folded over and sealed to form what is called a pinch-bottom bag. Alternatively, the end may be formed with two sets of flaps, arranged in opposed pairs. The first pair of opposed flaps are folded inwardly toward one another (in-folded flaps). The two other flaps (outer flaps), typically oriented perpendicular to the in-folded flaps, would be folded over the already folded in-folded flaps and glued in place to close that end of the bag. Typically, in its flattened configuration, the end of the bag will assume a generally hexagonal shape, thus leading to such bags typically being called "diamond-bottom" bags. When such a bag is filled, the bottom of the bag will assume a square-bottom shape, although the length of the bag will not have specifically defined panels but may be generally tubular with an elongated oval cross-section.

Rather than leave the opposite end of the bag completely open for filling by the manufacturer/purchaser of the unfinished bag, the bag end can be filled with the opposite (purchaser) end of the bag substantially closed, so long as a valve is provided. In a valve bag, the purchaser end is closed in the second manner described above. The tubular bag form is flattened somewhat, and the in-folded flaps correspond to the two opposite "short" sides of the bag. The in-folded flaps may or may not overlap. The outer flaps, which correspond to the "long" sides of the bag, are then folded over one another, and glued to each other. In addition, one of the in-folded flaps may be glued to one or more of the outer flaps. The remaining in-folded flap is typically not glued to either the outer flaps or the other in-folded flap, and so a channel is often formed, upon outward deflection of the glued and overlapped outer flaps, leading to the interior of the bag. If the in-folded flaps overlap, the flap is located on the side of the "under" flap. Filling can be accomplished by the insertion of an appropriately configured nozzle, which will extend to the gap between the in-folded flaps, to drop material into the interior of the bag, or if the in-folded flaps overlap, the nozzle will project under the "over" flap and into the bag far enough to clear the "under" flap and access the interior of the bag. After filling, the valve may then be closed by some suitable manner, such as by folding over and gluing down the end of the flap to the side of the bag, or by sealing the end of the valve such as with ultrasonic or thermal sealing (such as when the interior of the valve is provided with a polyethylene film liner or coating or an adhesive coating of some form). However, although all of the flaps have been folded over and glued, in a typical prior art construction valve bag, such as that illustrated in FIG. 1 and FIG. 2, there remain several points of possible leakage, through, for example, powder migration, wherein the various folded over flaps have resulted in several potential channels for access to the interior of the bag. Although such channels may be labyrinthine in nature, there still remains the possibility of some migration, sifting or puffing out of the granular, powdery or particulate material from the interior of the bag when the bag is being handled. Although such puffing or sifting can be avoided through the provision of a separately sealed liner to the bag, such as a polyethylene film liner, such liners add to the cost and complexity of the bag as well as to the cost and complexity of the filling and closure procedures.

Accordingly, it would be desirable to be able to provide a valve bag which is not provided with a separate, separately closed and entirely sealed liner, but which is provided with enhanced resistance to sifting or puffing out of particulate material, after filling of the bag and during the subsequent handling of same.

This and other objects of the invention will become apparent in view of the present specification (including claims) and drawings.

SUMMARY OF THE INVENTION

The present invention is a valve bag apparatus, for the containment of material, which comprises a generally tubular bag body portion, having a first end portion and a second end portion and a longitudinal axis extending therebetween the first and second end portions. At least one of the first and second end portions has at least one in-folded flap member, extending from the body portion inwardly toward the longitudinal axis of the valve bag apparatus. At least one outer flap member is associated with the at least one in-folded flap member, foldable to a position over and to the outside of the at least one in-folded flap member. The outer flap member and the inner flap member form at least one passageway from an interior region of the valve bag apparatus to an exterior region of the valve bag apparatus, when the outer flap member is in an unfolded orientation. A cover member is operably affixed to at least a portion of both the at least one in-folded flap member and the at least one outer flap member, for substantially closing off the passageway from the interior region of the valve bag apparatus to the exterior region of the valve bag apparatus.

The valve bag apparatus in a preferred embodiment of the invention further comprises a valve member, operably disposed at one of the first and second end portions, and adjacent to and between the at least one in-folded flap member and the cover member, so as to provide a valve passage from the interior region of the valve bag apparatus to the exterior region of the valve bag apparatus, the cover member being operably disposed so as to permit passage of material through the valve passage in the valve member, while precluding movement of material from the interior region of the valve bag apparatus to the exterior region of the valve bag apparatus by any other route.

The at least one in-folded flap member preferably comprises two in-folded flap members disposed upon substantially opposite sides of the bag body portion at at least one of the first and second ends of the bag body portion, and the at least one outer flap member comprises two outer flap members operably disseminating from substantially opposed sides of at least one of the first and second end portions of the bag body portion. The at least one cover member substantially covers at least portions of each of the two in-folded flap members and at least portions of each of the two outer flap members.

Preferably, each of the first and second end portions of the bag body portion is provided with at least one in-folded flap member, at least one outer flap member, and at least one cover member.

The cover member preferably comprises a substantially flat rectangular sheet member, having a peripheral edge region, wherein the cover member is positioned so as to cover at least a portion of one of the at least one in-folded flap member and the at least one outer flap member, and affixed thereto by adhesive material operably disposed substantially entirely along the peripheral edge region.

The bag body portion is configured from at least one ply of material. Preferably, the bag body portion is configured from two or more plies of material.

In an embodiment of the invention, at least one ply of material is fabricated from kraft paper. In another embodiment of the invention, at least one ply of material is fabricated from plastic material.

The cover member, in one embodiment of the invention, is fabricated from the same material as at least one ply of material. In another embodiment of the invention, the cover member is fabricated from a material which is different from that from which the bag body portion is fabricated.

DETAILED DESCRIPTION OF THE DRAWINGS

While the present invention is susceptible of embodiment in many different forms, there will be described herein in detail, a specific embodiment, with the understanding that the embodiment illustrated is to be considered as an exemplification of the principles of the invention, and is not intended to limit the invention to the embodiment illustrated.

Figure 2:
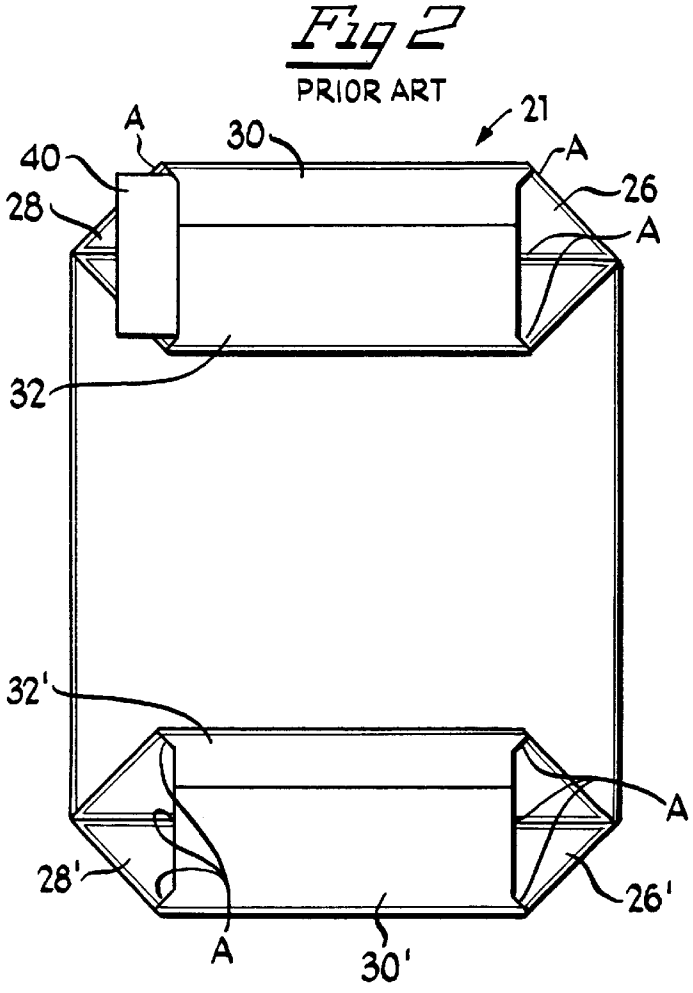
Fig 2 PRIOR ART
FIG. 2 is a top plan illustration of the prior art valve bag of FIG. 1, after the outer flaps have been folded over and affixed into place.
Figure 1:
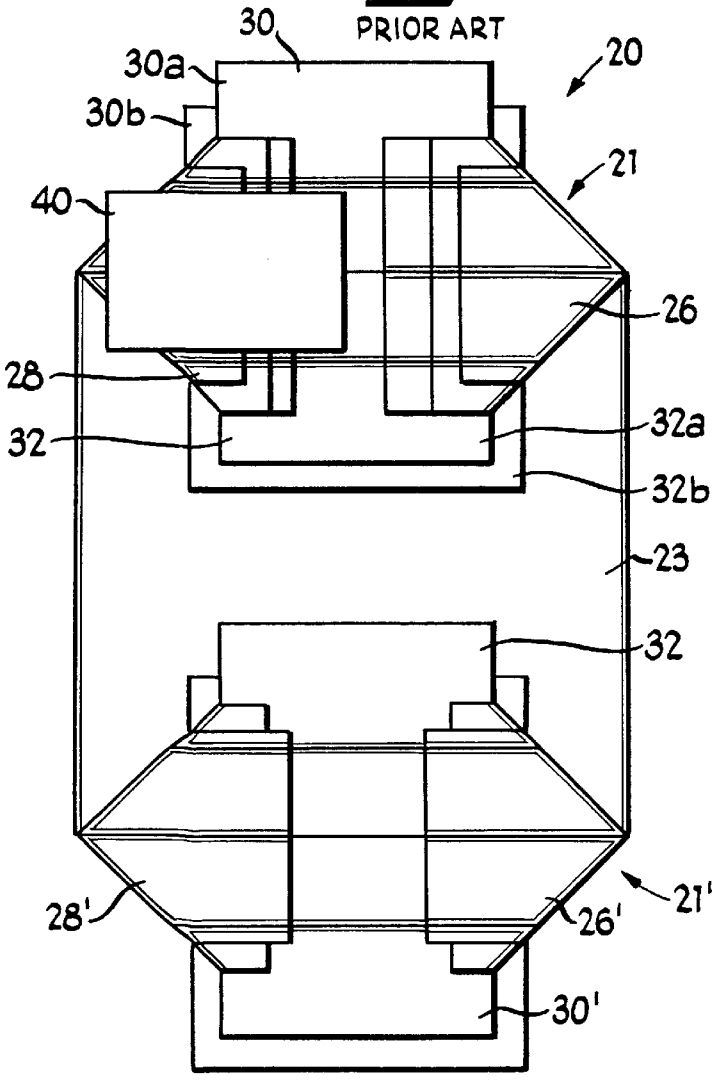
Fig 1 PRIOR ART
FIG. 1 is a top plan view a prior art valve bag, wherein the in-folded flaps for each end have been folded inward and the outer flaps remain in their unarticulated configuration.

Prior art valve bag 20 is illustrated in FIGS. 1 and 2. Bag 20 includes a generally tubular body portion 23, which may be formed from a single ply of bag material, or which, as illustrated, may, be formed from two or more plies of bag material which have been together or separately formed as tubes, one within the other. Bag 20 also includes in-folded flaps 26 and 28, 26' and 28'. Bag 20 also includes outer flaps 30 and 32, and 30' and 32'.

Bag 20 typically will be formed with slightly different ends. Customer end 21 will be the end at which the valve will be provided. Manufacturer end 21' typically will be closed at the time of initial manufacture of the bag. As can be seen from FIG. 1, typically the in-folded flaps 26, 28 of customer end 21, may be cut in a stepped manner, so that the separate plies making up body 23 will be exposed. This is typically to facilitate gluing of the flaps at the customer end so that different plies will be glued to one another, facilitating the strength and completeness of the closure, as well as to facilitate the provision of the valve structure. At the manufacturer's closed end 21', the various flap members, in particular the in-folded flaps 26' and 28', are not cut in a stepped manner, although they may be cut in a stepped manner. In the process of making bag 20, before outer flaps 30 and 32 are folded down and glued into place, a valve member 40, which may be in the form of a single, flattened tube of material, or which may be two overlying flat rectangular pieces surrounding a further valve line structure, is positioned and affixed onto in-folded flap 28 of bag 20. Once valve member 40 is in place, then adhesive is applied to the upper side of valve member 40, among other areas, and outer flaps 30, 32 are folded over and affixed into place. An inner end of valve member 40 must extend to a position which is somehow between in-folded flaps 26 and 28 so as to open onto the interior of the bag 20, once the bag has been inflated slightly from its flattened state, as illustrated in FIGS. 1 and 2. Typically such inflation is accomplished by the insertion of a nozzle into valve member 40, thus causing valve member 40 to assume a tubular (although possibly somewhat flattened) configuration. Air may then be blown into bag 20 prior to actual filling of same, to accomplish the inflation of the bag to facilitate filling.

Prior to such filling, however, prior art bag 20 will have the configuration illustrated in FIG. 2. Due to the configuration of the in-folded flap and the overlying outer flaps, as well as the typical method of cutting and forming same in a prior art valve bag, even after gluing and folding over of the flaps into the configuration illustrated in FIG. 2, there exist in a typical prior art valve bag, avenues through which particulate or granular material contained in the bag may escape, once the bag has been inflated and filled. Such avenues of escape of the material are indicated in FIG. 2 at the locations designated A. Such locations provide not only avenues for escape of particulate material during handling of the filled bag, but also may provide avenues for the entry of external dirt or particulate material to enter into and thus contaminate the contents of the bag.

Figure 4:
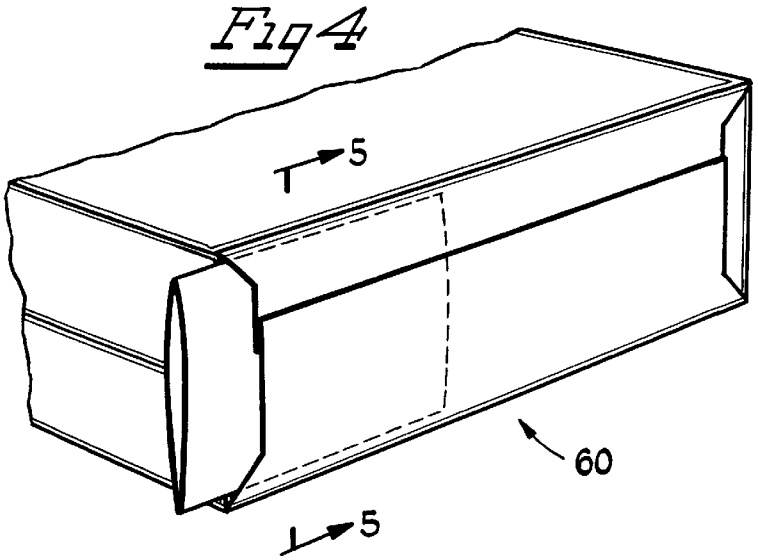
FIG. 4 is an end perspective view of the valve bag of FIG. 3.
Figure 5:
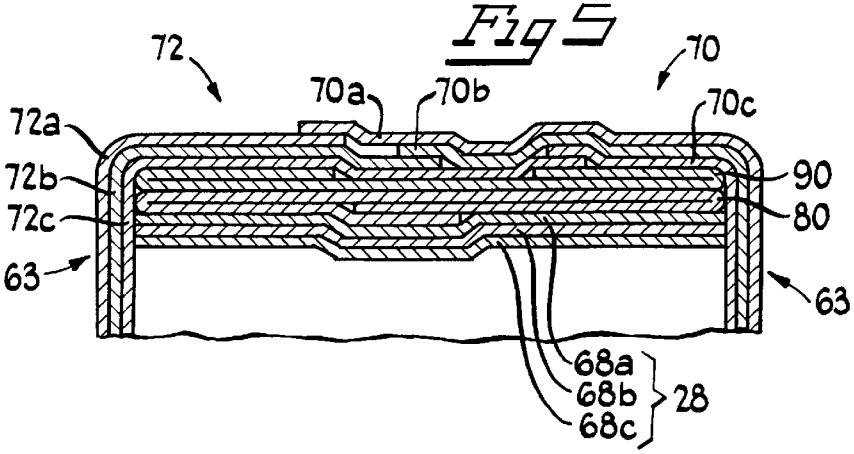
FIG. 5 is a side elevation of the valve bag of FIG. 3, in section, taken along lines 5—5 of FIG. 4, and looking in the direction of the arrows.
Figure 3:
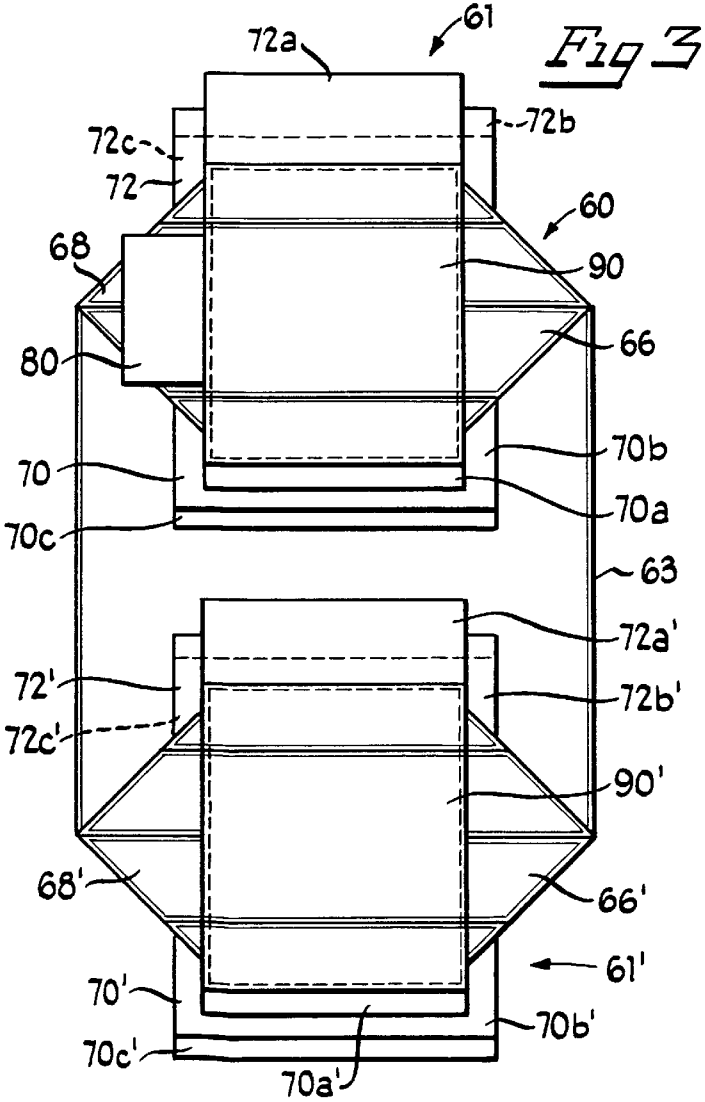
FIG. 3 is a top plan view of an improved valve bag, according to a preferred embodiment of the present invention, showing the cover member in place.

The improved valve bag of the present invention is illustrated in FIGS. 3 through 5. In FIG. 3, a valve bag according to the present invention is shown in its configuration at a state of assembly which is substantially the same as the stage of assembly illustrated in FIG. 1 relative to the prior art bag. Apart from as described hereinafter, the configuration and manner of forming of the in-folded flaps and outer flaps may be generally according to the same techniques and configuration as previously described with respect to the prior art bag of FIGS. 1 and 2 and accordingly such elements need not be discussed in extensive detail. Improved sift proof valve bag 60 may be formed, in an otherwise conventional manner, from one or more plies (3 plies are illustrated in the embodiment of FIGS. 3–5) of container material to produce a generally tubular, though flattened body 63, having a customer end 61 and a manufacturer end 61'. The bag 60 may be formed solely from kraft paper, or it may be manufactured from other materials. An inner ply of plastic material might be provided. Alternatively, a coating of plastic or water-proofing material may be placed on the surface of a ply of kraft paper. Customer end 61 may be provided with in-folded flaps 66 and 68 and outer flaps 70 and 72, as well as a valve member 80. Manufacturer end 61' may be provided with in-folded flaps 66' and 68', as well as outer flaps 70' and 72'.

After placement and affixation of valve member 80, but prior to closure of either of ends 61 or 61', cover members 90 and 90' are placed in a substantially overlying relationship to each of the flattened unclosed ends. Each cover member 90, 90' will be generally rectangular in configuration, and will have dimensions sufficient to ensure that the edge of the cover member covers or extends above, directly or indirectly, the in-folded flap members, the valve member, and the outer flap members, such that any and all areas which may lead to access to the interior of the bag, once the bag has been inflated and filled, are completely closed off by the cover member. Cover member(s) 90, 90' may be fabricated from a material similar to that from which the body portion is fabricated, such as kraft paper or even a plastic material. Alternatively, the cover member(s) may be fabricated from a different material, relative to the body portion. For example, a bag having a body portion fabricated solely from kraft paper could possibly have a plastic cover member, or vice versa. Other, non-porous materials could possibly be used for the cover member. Prior to placement of each cover member 90', a line of adhesive will be placed in a substantially continuous manner all around the periphery of the cover member, such as in a manner illustrated by the dotted lines of FIG. 3, or in a manner which provides that once the cover member is in place, the line of adhesive will be continuous, so that no avenue for escape of material from the interior of the bag remains, apart from the passage of material through the valve member 80 upon filling of same. Cover members 90, 90' affect the complete sealing of their respective ends of the bag, even before the outer flaps 70, 72, 70', 72' are folded over. Thereafter, outer flaps 70, 72 and 70',72' may be folded over and affixed to one another in an otherwise conventional manner.

It is to be noted that in the prior art configuration, wherein a multiple ply bag is provided, at one or more of the ends 21, 21' of bag 20, an inner ply 30A of outer flap 30 has a width which is less than outer ply 30B, while inner ply 30A extends laterally a greater distance than outer ply 30B, while conversely, inner ply 32A of outer flap 32 is both smaller and narrower than outer ply 32B. Such a construction is well known among prior art valve bags having stepped end cuts and may be accomplished, for various manufacturing and handling reasons. In the valve bag of the present invention, the outer plies 70B, 70C, 728, 72C, 72'B, 72'C and 70'B and 70'C are all greater in length (that is, from side to side as illustrated in FIG. 3) than their corresponding innermost plies 70A, 72A, 72'A and 70'A, although not necessarily greater in lateral extension (the up-and-down direction as FIG. 3 is viewed). This is to provide a sufficient backing area for the respective cover members to ensure that no avenues of escape of or entry of material remain.

Once outer flaps 70, 72 and 72', 70' have been folded over and affixed, valve bag 60 may be filled and subsequently sealed in any suitable manner, including any known conventional manner.

FIGS. 4 and 5 illustrate a perspective view of the valve end of bag 60, which is fabricated as a multilayer bag (having innermost "a" and outermost "b" and "c" layers), as well as a sectional view of valve bag 60, indicating the sealing afforded by the cover member 90. In-folded flap 68 can be seen to comprise layers 68*a*, 68*b* and 68*c*. Valve member 80 is provided as a single planar member which has been rolled into tube form, affixed (such as by adhesive) and flattened. Outer flaps 72 and 70 are each comprised of multiply layers (as are the side wall or body portions 63), and are cut in a step-wise fashion. Cover member 90 which is affixed atop valve member 80, does not overlap itself, being affixed to the innermost layers of outer flaps 72 and 70 prior to the folding over of the outer flaps.

While in the embodiments illustrated, cover members are placed at both ends of the valve bags, in alternative embodiments, the cover members may be only placed at one end. In addition, the principles of the present invention are also applicable to bags having constructions which may be generally similar to the valve bags which are illustrated, but in which the valve portions have been omitted, and the ends merely closed.

The foregoing description and drawings merely explain and illustrate the invention, and the invention is not limited thereto, except insofar as the appended claims are so limited, as those skilled in the art who have the disclosure before them will be able to make modifications and variations therein without departing from the scope of the invention.

What is claimed is:

1. A valve bag apparatus, for the containment of material, comprising:

a generally tubular bag body portion, having a plurality of layers, including at least one outer layer fabricated from a non-weldable material, said generally tubular bag body portion further having a first end portion and a second end portion and a longitudinal axis extending therebetween the first and second end portions;

at least one of said first and second end portions having a substantially diamond-bottomed configuration prior to closure and sealing of same, and further having two opposed in-folded flap members extending from said body portion inwardly toward said longitudinal axis of said valve bag apparatus, the two opposed in-folded flap members having inwardly extending free peripheral edges, the inwardly extending free peripheral edges of the two opposed in-folded flat members further having outer surfaces facing away from an interior region of the tubular bag body portion, said at least one of said first and second end portions further having two opposed outer flap members, associated with and arranged substantially perpendicular to the two opposed in-folded flap members, foldable to a position over and to the outside of the two opposed in-folded flap members, at least a portion of one of the two opposed outer flap members overlapping at least a portion of the other of the two opposed outer flap members, when the opposed outer flap members are folded to said position over and to the outside of the two in-folded flap members;

the two opposed outer flap members having innermost surfaces, the innermost surfaces further having peripheral edges;

said outer flap members and said in-folded flap members forming at least one passageway from an interior region of the valve bag apparatus to an exterior region of the valve bag apparatus, when said outer flap members are in their folded orientation;

a unitary cover member which is substantially continuously affixed about its peripheral edge to the outer surfaces of the free peripheral edges of the in-folded flap members and, simultaneously, over the peripheral edges of the innermost surfaces of the outer flap members, where the free peripheral edges of the in-folded flap members adjoin respective peripheral edges of the outer flap members, for substantially sealing the passageway from the interior region of the valve bag apparatus to the exterior region of the valve bag apparatus, the cover member being positioned relative to said at least one of said first and second end portions of the tubular bag body portion, so as to leave a remaining portion of each of the two opposed outer flap members uncovered, for enabling the direct juxtapositioning and sealing of the remaining exposed portions of the two opposed outer flap members to one another.

2. The valve bag apparatus according to claim 1, further comprising:

a valve member, operably disposed at one of said first and second end portions, and adjacent to and between the at least one in-folded flap member and the cover member, so as to provide a valve passage from the interior region of the valve bag apparatus to the exterior region of the valve bag apparatus, the cover member being operably disposed so as to permit passage of material through the valve passage in the valve member, while precluding movement of material from the interior region of the valve bag apparatus to the exterior region of the valve bag apparatus by any other route.

3. The valve bag apparatus according to claim 1, wherein the at least one in-folded flap member comprises two in-folded flap members disposed upon substantially opposite sides of the bag body portion at at least one of the first and second ends of the bag body portion, and the at least one outer flap member comprises two outer flap members operably disseminating from substantially opposed sides of at least one of the first and second end portions of the bag body portion, and wherein the at least one cover member substantially covers at least portions of each of the two in-folded flap members and at least portions of each of the two outer flap members.

4. The valve bag apparatus according to claim 1, wherein each of the first and second end portions of the bag body portion is provided with at least one in-folded flap member, at least one outer flap member, and at least one cover member.

5. The valve bag apparatus according to claim 1, wherein the cover member comprises a substantially flat rectangular sheet member, having a peripheral edge region, wherein the cover member is positioned so as to cover at least a portion of one of the at least one in-folded flap member and the at least one outer flap member, and affixed thereto by adhesive material operably disposed substantially entirely along the peripheral edge region.

6. The valve bag apparatus according to claim 1, wherein the bag body portion is configured from at least one ply of material.

7. The valve bag apparatus according to claim 6, wherein the bag body portion is configured from two or more plies of material.

8. The valve bag apparatus according to claim 6, wherein at least one ply of material is fabricated from kraft paper.

9. The valve bag apparatus according to claim 6, wherein at least one ply of material is fabricated from plastic material.

10. The valve bag apparatus according to claim 6, wherein the cover member is fabricated from the same material as at least one ply of material.

11. The valve bag apparatus according to claim 6, wherein the cover member is fabricated from a material which is different from that from which the bag body portion is fabricated.

* * * * *

UNITED STATES PATENT AND TRADEMARK OFFICE

CERTIFICATE OF CORRECTION

PATENT NO. : 5,967,664
DATED : October 19, 1999
INVENTOR(S) : Giles et al.

It is certified that error appears in the above-identified patent and that said Letters Patent is hereby corrected as shown below:

Column 5,
Line 42, delete "728" and insert -- 72B --

Signed and Sealed this

Twenty-ninth Day of April, 2003

JAMES E. ROGAN
*Director of the United States Patent and Trademark Office*